US012203329B2

(12) United States Patent
Mishkhes et al.

(10) Patent No.: US 12,203,329 B2
(45) Date of Patent: Jan. 21, 2025

(54) TUBING WITH SELECTIVE ACTIVATED LANDING PROFILE FOR WELL COMPLETION

(71) Applicant: Saudi Arabian Oil Company, Dhahran (SA)

(72) Inventors: Abdulrahman Mishkhes, Dhahran (SA); Fuad A. AlSultan, Al-Ahsa (SA); Ahmad M. AlMousa, Mubarraz (SA)

(73) Assignee: Saudi Arabian Oil Company, Dhahran (SA)

( * ) Notice: Subject to any disclaimer, the term of this patent is extended or adjusted under 35 U.S.C. 154(b) by 100 days.

(21) Appl. No.: 17/960,541

(22) Filed: Oct. 5, 2022

(65) Prior Publication Data

US 2024/0117684 A1 Apr. 11, 2024

(51) Int. Cl.
*E21B 17/04* (2006.01)

(52) U.S. Cl.
CPC ..... *E21B 17/04* (2013.01)

(58) Field of Classification Search
CPC ... E21B 17/04; E21B 23/04115; E21B 33/128
See application file for complete search history.

(56) References Cited

U.S. PATENT DOCUMENTS 1,941,813 A * 1/1934 Nixon ..... E21B 23/04 166/212
2,227,347 A * 12/1940 Johnson ..... E21B 23/0411 30/106
3,131,769 A * 5/1964 De Rochemont ..... E21B 23/04115 166/212
3,978,921 A * 9/1976 Ross ..... E21B 36/001 166/212
5,531,280 A * 7/1996 Steinkamp ..... E21B 4/18 175/230
5,585,555 A * 12/1996 McRae ..... G01B 5/30 33/542.1
10,961,805 B1 * 3/2021 Saeed ..... E21B 33/1216

* cited by examiner

*Primary Examiner* — David Carroll
(74) *Attorney, Agent, or Firm* — Fish & Richardson P.C.

(57) ABSTRACT

A tubular joint for a well string includes an elongated tube that includes an inner surface and an outer surface; a thrusting element affixed to the inner surface of the tubular joint; and a landing pad disposed along the tubular joint, the landing pad secured to the thrusting element by a spring. The landing pad is configured to move outward from the outer surface relative to the thrusting element.

20 Claims, 9 Drawing Sheets

(View A-A)

TUBING WITH SELECTIVE ACTIVATED LANDING PROFILE FOR WELL COMPLETION

TECHNICAL FIELD

The present disclosure applies to selective activated tubing profiles for well completion.

BACKGROUND

A mono-bore typically refers to a well drilled as a single-diameter hole from the surface casing to total depth. A mono-bore well can be drilled in less time than other designs. The mono-bore approach results in a greater casing diameter in the lateral, which facilitates larger completion volumes and higher flow rates into the well. The larger diameter lateral also provides for an easier re-entry into the well in the future. The mono-bore uses only one drill bit type and one bottom hole assembly configuration to reach total depth.

SUMMARY

The present disclosure describes techniques that can be used for completing wells with a mono-bore completion. Aspects of the present disclosure provide oil, gas, and water well operators with the ability to install mono-bore (invariable diameter) completion that is supplemented with an ad-hoc retractable landing profile. Three different modes of operations can be used to deploy the landing profiles by means of mechanical, and/or hydraulic, and/or electrical activation.

In some implementations, a computer-implemented method includes the following. A tubular joint for a well string can include an elongated tube that includes an inner surface and an outer surface; a thrusting element affixed to the inner surface of the tubular joint; a landing pad disposed along the tubular joint, the landing pad secured to the thrusting element by a spring; wherein the landing pad is configured to move outward from the outer surface relative to the thrusting element.

The described implementations are implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method/the instructions stored on the non-transitory, computer-readable medium.

The subject matter described in this specification can be implemented in particular implementations, so as to realize one or more of the following advantages. For example, aspects of the disclosure provide a way to maintain consistent internal diameter throughout the length of the tubing string, which can facilitate the running of large tools through the string to carry out operations in the lower completion. In addition to providing accessibility, aspects of the embodiments can reduce the risk of scale precipitation, which can occur in conventional landing profiles. Scale precipitation in the downhole well tubulars increases at each pressure drop interval. Because tubular sections with different internal diameters (restrictions) are classified as pressure drop areas, maintaining a constant internal diameter can reduce the risk of scale precipitation. The landing pads described herein allow for a constant internal diameter while also securing the tubular in the wellbore.

In addition, maintaining constant tubular internal diameter also lowers the risk of having the tool being stuck downhole. The accessibility gained from running the completion is valuable, especially for mature wells that went through multiple workovers that led to installing more casing strings; hence wells will be completed with slim tubing sizes such as 2⅜" and 2⅞". Thus, maintaining the constant tubular internal diameter also mitigates the risk getting stuck or losing well intervention tools can result.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

BRIEF DESCRIPTION OF THE DRAWINGS

Like reference numbers and designations in the various drawings indicate like elements. Figures are not drawn to scale.

DETAILED DESCRIPTION

The following detailed description describes techniques for completing a well adding a tubing joint that includes an adjustable (ad-hoc retractable) landing profile into the tubing string for a mono-bore completion, including slim mono-bore completions. Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

Aspects of this disclosure are directed to devices and techniques to complete wells, including wells with slim mono-bore completion. The tubing described herein includes selectively activated landing pads to install and secure mono-bore (invariable diameter) completion for production wells, including oil, gas, and water wells. The selectively activated landing pads result in tubing with an ad-hoc adjustable landing profile. The selectively activated landing profile of the tubing facilitates consistent internal diameter throughout the length of the tubing string, which is useful for running large tools down string to carry out operations in the lower completion. In addition to providing accessibility, aspects of the embodiments can reduce the risk of scale precipitation which usually occurs in conventional landing profiles. Three different modes of operations are used to deploy the landing profiles by means of mechanical, hydraulic, and/or electrical activation. Various embodiments and implementation choices are described below.

Figure 1B:
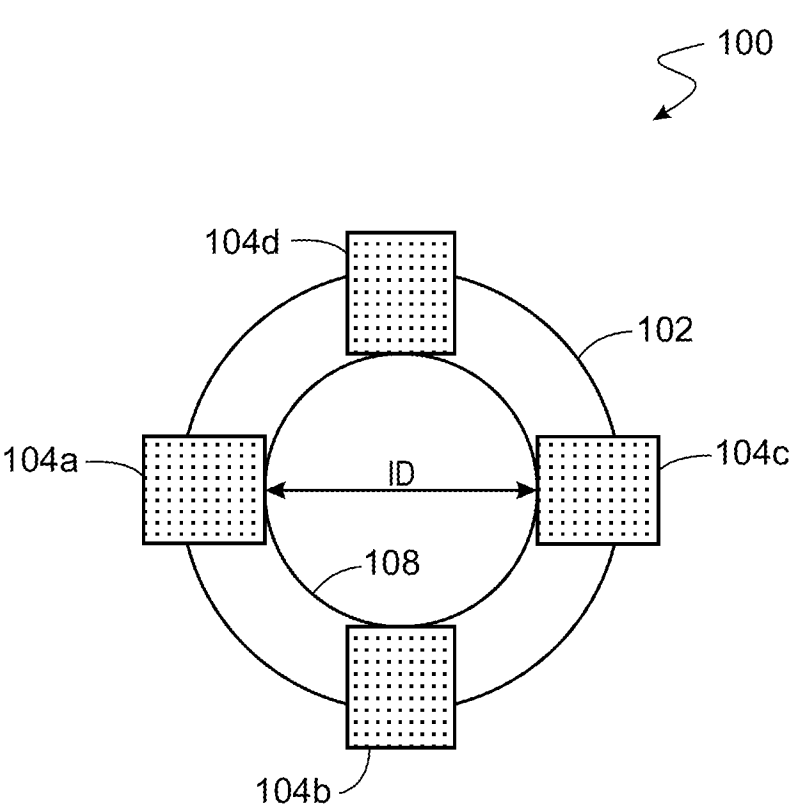
FIG. 1B is a second, sectional view of a schematic diagram of the example tubing with selective activated landing profile of FIG. 1A according to some implementations of the present disclosure.
Figure 1A:
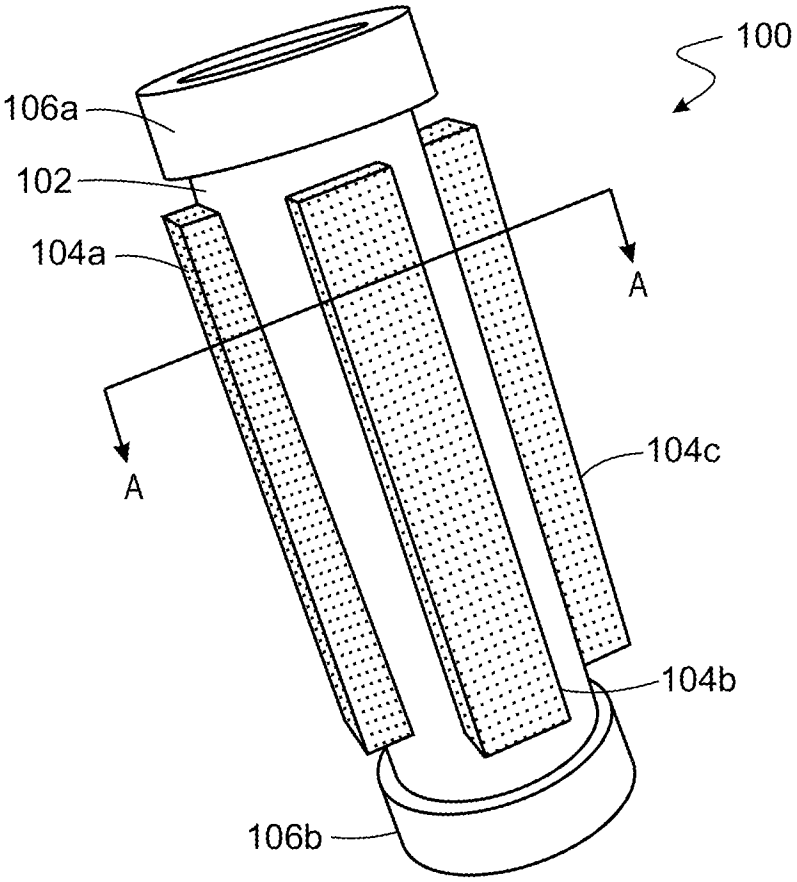
FIG. 1A is a first view of a schematic diagram of an example tubing with selective activated landing profile according to some implementations of the present disclosure.

FIG. 1A is a first view of a schematic diagram of an example tubing 100 with selective activated landing profile according to some implementations of the present disclosure. FIG. 1B is a second, sectional view of a schematic diagram of the example tubing with selective activated landing profile of FIG. 1A according to some implementations of the present disclosure. The tubing 100 can be a portion of a wellbore completion, such as that used for slim monobore designs. The tubing 100 can be a tubular joint or other sectional piece of a completion, drill string, well string, or other type of wellbore completion. The tubing 100 can include an outer surface 102 and an inner surface 108 (inner surface 108 having an inner diameter ID).

The tubing 100 can include a first flange 106*a* disposed at a first distal end of the tubing 100. The tubing 100 can also include a second flange 106*b* disposed at a second distal end of the tubing 100, opposite the first distal end. The flanges 106*a* and 106*b* can be used as couplings for other sections of tubing or other components in the completion. The flanges 106*a* and 106*b* also define a first outer diameter of the tubing 100 (shown in FIGS. 2A-B). The flanges 106*a* and 106*b* can protect the tubing 100 and landing pads 104*a-d* while the tubing 100 is positioned within the wellbore. The flanges 106*a* and 106*b* can also help to guide the tubing 100 into the wellbore.

The tubing 100 also includes one or more landing pads, here shown with four landing pads 104*a*, 104*b*, 104*c*, and 104*d*. The landing pads 104*a-d* are movable in a radial direction relative to the tubing 100 to secure the tubing 100 in the wellbore. In addition, the landing pads 104*a-d* are designed (and sized) to not obstruct the passage of tools and production materials through the tubing 100 at least during operation of the well and when the landing pads 104*a-d* are extended outwards towards the surface of the wellbore. The landing pads 104*a-d* are shown to be arranged at equidistant locations around the circumference of the tubing surface 102. The landing pads 104*a-d* can be installed on 1-3 feet of tubing joints. The tubing joints can be threaded to the tubing when designing and running the well tubular during the well completion phase.

The operation of the landing pads 104*a-d* is illustrated in more detail in FIGS. 2A-B below.

Figure 2A:
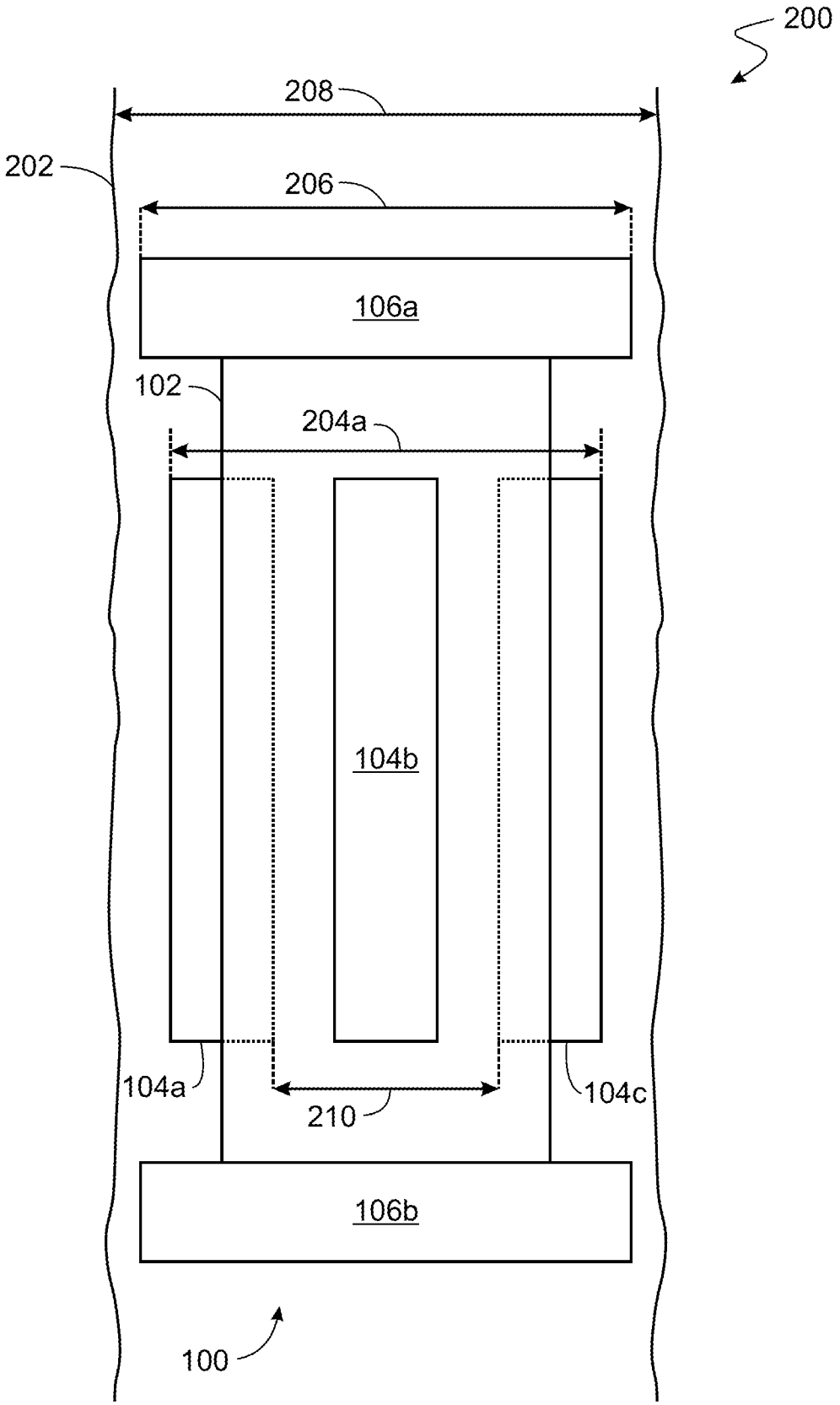
FIG. 2A is a schematic diagram of an example tubing with selective activated landing profile in a wellbore with landing pads retracted in accordance with embodiments of the present disclosure.
Figure 2B:
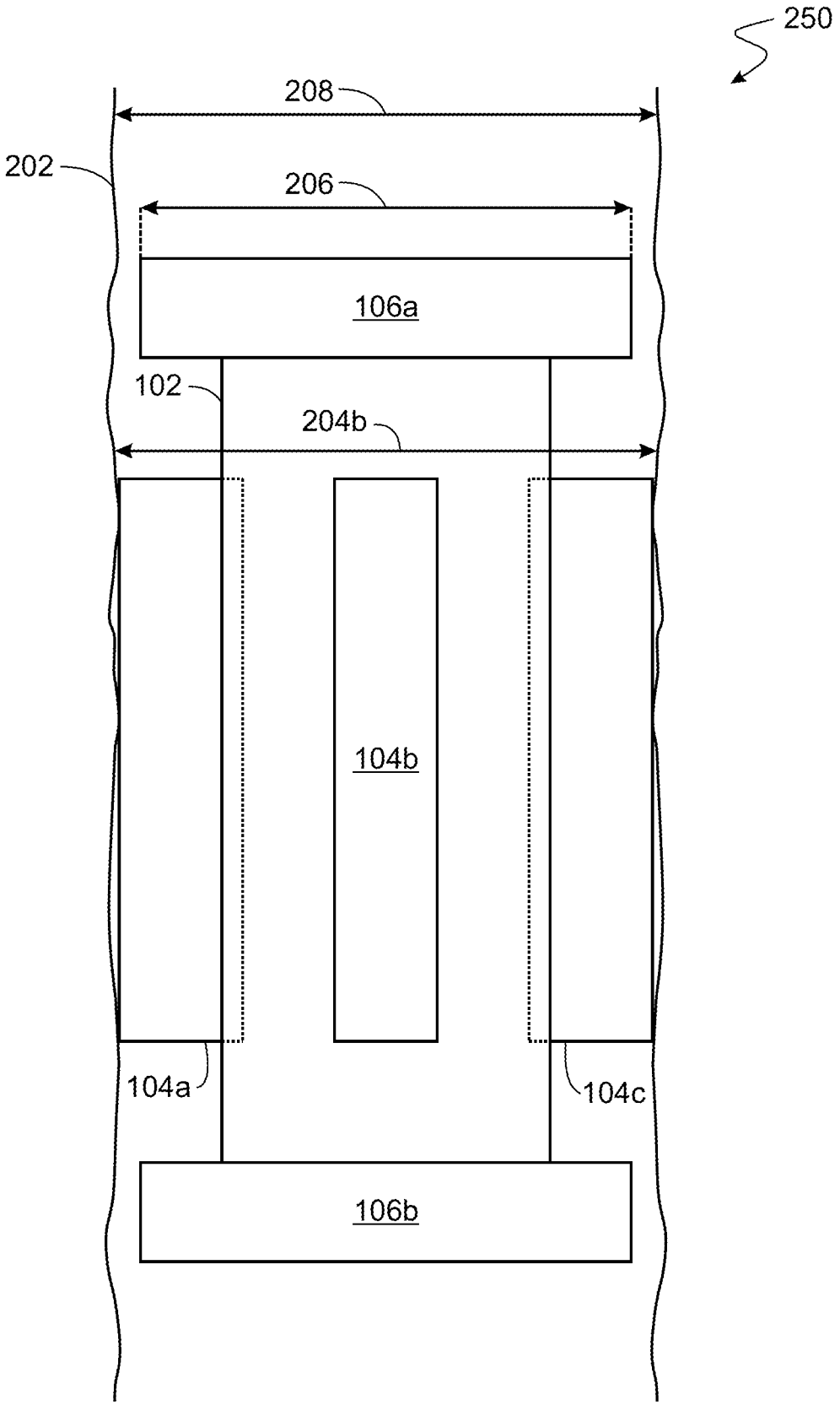
FIG. 2B is a schematic diagram of the example tubing with selective activated landing profile of FIG. 2A in a wellbore with landing pads extended in accordance with embodiments of the present disclosure.

FIGS. 2A and 2B illustrate the tubing 100 within a wellbore having wellbore surface 202 (or wellbore casing surface 202, if a wellbore casing is used). FIG. 2A is a schematic diagram 200 of an example tubing 100 with selective activated landing profile in a wellbore with landing pads retracted in accordance with embodiments of the present disclosure. In FIG. 2A, the tubing 100 is shown with landing pads 104*a*, 104*b*, and 104*c* in a retracted position. The retracted position allows for the tubing 100 to be positioned and repositioned prior to being secured in place and coupled to other components of the completion. While in the retracted position, two opposing landing pads (e.g., landing pads 104*a* and 104*c*) define a landing pad diameter 204*a*. This landing pad diameter can be less than or equal to the outer diameter of the tubing 206 defined by the flanges 106*a* and 106*b*. Outer diameter of the tubing 106 can be just less than the wellbore diameter 208 (or wellbore casing) so that the tubing 100 can be positioned and moved in the wellbore.

In FIG. 2A, the dashed lines adjoining the landing pads 104*a* and 104*c* indicate unseen portions of the landing pads. In FIG. 2A, the unseen portion of the landing pads 104*a-d* can be bound by the inner diameter ID of the tubing 100 (shown in FIG. 1B). In embodiments, the landing pads 104*a-d* can extend into the interior of the tubing 100 past the inner diameter ID. In either case, the retracted position of the landing pads can define an inner diameter 210 of the tubing 100 when the landing pads 104*a-d* are retracted and the tubing 100 is not operational. More importantly, however, is that when in the extended position and during operation of the well, the landing pads 104*a-d* do not extend into the interior of the wellbore. Thus, the landing pads 104*a-d* can be designed and sized so that, when extended, the landing pads 104*a-d* secure the tubing 100 in the wellbore and do not extend into the tubing 100 to interfere with operation of the well or the movement down string tools.

FIG. 2B is a schematic diagram 250 of the example tubing 100 with selective activated landing profile of FIG. 2A in a wellbore with landing pads extended in accordance with embodiments of the present disclosure. In FIG. 2B, the landing pads 104*a* and 104*c* are shown in an extended position. In the extended position, the landing pads define a second landing pad diameter 204*b* of the tubing 100. The second landing pad diameter 204*b* can be nearly equal to the wellbore diameter 208 (or wellbore casing diameter) such that the landing pads 104*a-d* secure the tubing 100 in the wellbore by friction and other forces. In FIG. 2B, the landing pads 104*a* and 104*c* are shown to be not fully extended past the outer surface 102. By over-sizing the landing pads slightly, the highest securing force against the surface 202 can be achieved. The landing pads 104*a-d* can establish a landing profile that is activated after landing the tubing in the wellbore prior to operation. An operator can increase the landing profile for well securement in case of, for example, well integrity issues that are addressed by shallow securement. Tubing securement is achieved, thus, without interfering with the well.

FIGS. 3-4 describe example techniques that can be used to extend the landing pads 104*a-d* for securing the tubing 100 in the wellbore.

Figure 3A:
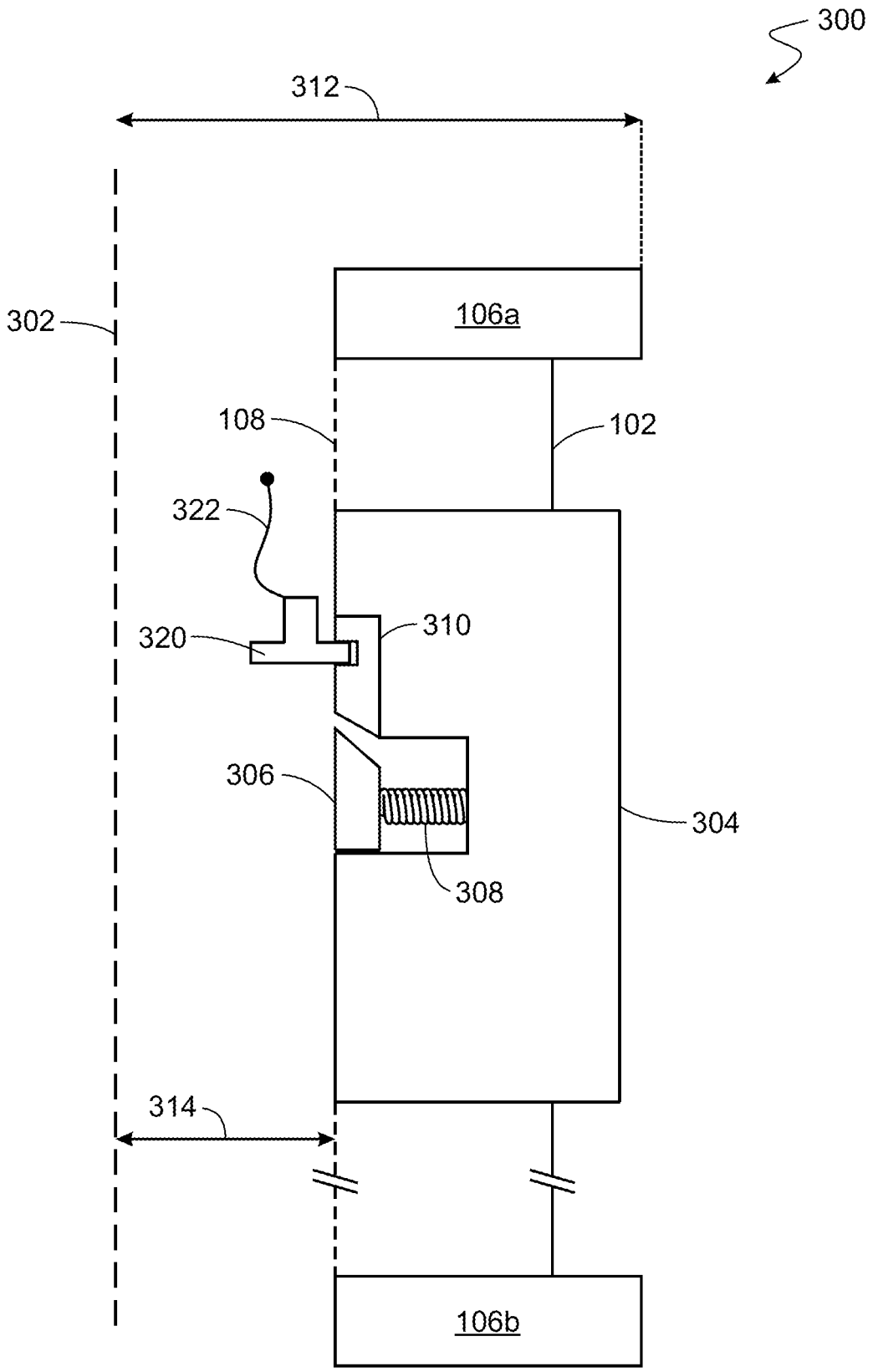
FIG. 3A is a schematic diagram of an example tubing with selective activated landing profile with a shifting key arrangement and landing pads retracted in accordance with embodiments of the present disclosure.
Figure 3B:
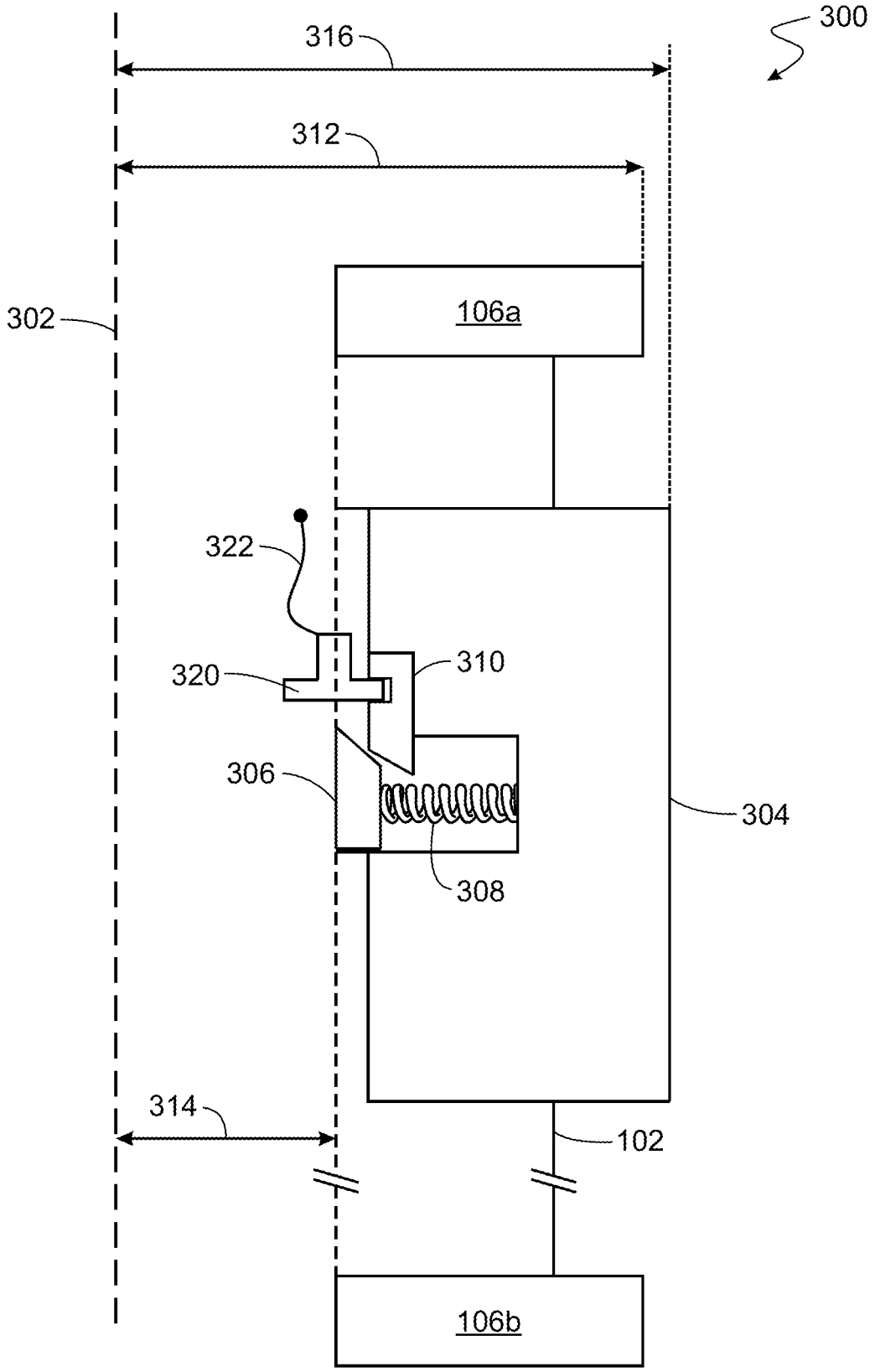
FIG. 3B is a schematic diagram of the example tubing with selective activated landing profile of FIG. 3A with a shifting key arrangement and landing pads extended in accordance with embodiments of the present disclosure.

FIG. 3A is a schematic diagram of an example tubing 300 with selective activated landing profile with a shifting key arrangement and landing pads retracted in accordance with embodiments of the present disclosure. FIG. 3B is a schematic diagram of the example tubing 300 with selective activated landing profile of FIG. 3A with a shifting key arrangement and landing pads extended in accordance with embodiments of the present disclosure. FIGS. 3A-B illustrate a half sectional view of an example embodiment of a tubing with selectively activated landing profile. A centerline 302 is shown that extends axially through the center of the tubing 300. The tubing includes an outer surface 102 and an inner surface 108 (shown as a dashed line). Tubing 300 has an inner diameter characterized by radius 314. The first outer diameter is based on the sizing of the flange 106*a* and is characterized by the radius 312 from the centerline to the outermost edge of the flange 106*a*.

The landing pad 304 (which is similar to landing pads 104*a-b*) is shown. Landing pad 304 can house a shifting key 310. Shifting key 310 can move in an axial direction parallel to the centerline 302. Shifting key 310 can include a notch or other receiver to receive a downhole shifting tool 320. Downhole shifting tool 320 can be controlled by an operator at the surface using a wireline 322.

The tubing 300 includes a thrusting element 306. Thrusting element 306 is rigidly affixed to a surface of the tubing 300, such as the inner surface 108 or a side-wall surface formed by inner surface 108 and outer surface 102. The thrusting element 306 need not be an integral part of the tubing 300. Thrusting element 306 can be installed into the cavity by a threaded screw or both or other securing member. The landing pad 304 is connected to the thrusting member 306 by a spring 308. The spring 308 has sufficient spring tension to hold the landing pad 304 in place when the thrusting member is not being interacted with.

In FIG. 3A, the shifting key 310 is not engaged and the landing pad 304 is in a "retracted" position. FIG. 3A shows the downhole shifting tool 320 engaged with the shifting key 310. As shown by example here, the shifting key 310 can include a shape (such as a wedge or inclined plane) that can interact with a corresponding shaped thrusting element 306. Such an interaction is shown in FIG. 3B. In FIG. 3B, the downhole shifting tool 320 moves the shifting key 310 axially towards the stationary thrusting element 306. In embodiments, because of the cooperating designs of the shifting key 310 and the thrusting element 306, the shifting key 310 can slide over the thrusting member 306, thereby pushing the landing pad 304 in a radial direction outwards from the outer surface 102 of the tubing 300 and towards the wellbore wall (when operated in a wellbore). The extension of the landing pad 304 is illustrated by the landing pad diameter characterized by radius 316 extending from the centerline 302 to an outer edge of the landing pad 304. In embodiments, the radius 316 is greater than or equal to radius 312. In implementations, radius 312 and radius 316 are not related to each other; radius 312 and radius 316 can be different or similar based on manufacturing design, implementation choices, wellbore needs, etc. Once secured, friction and counter force from the spring tension can hold the shifting key 310 in place, thereby holding the landing pad 304 in place to secure the tubing 300. The downhole shifting tool 320 can disengage from the shifting key 310 and be retrieved or sent to operate another shifting key 306.

If the tubing 300 is to be repositioned or removed, the operator can use the downhole shifting tool to shift the shifting key away from the thrusting element 306. The spring tension of spring 308 can retract the landing pad 304 away from the wellbore surface radially towards the outer surface 102 of the tubing 300.

Figure 4A:
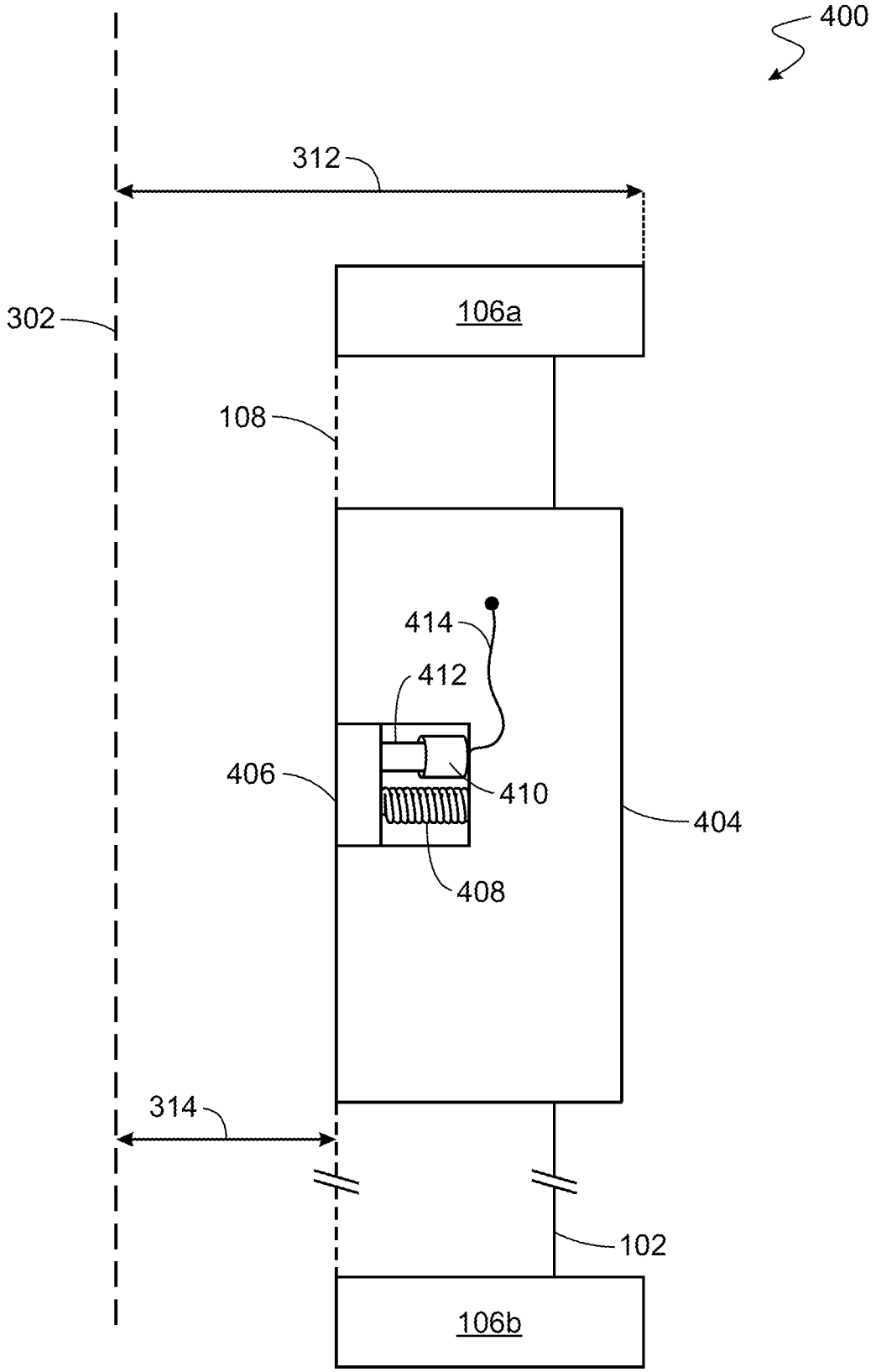
FIG. 4A is a schematic diagram of an example tubing with selective activated landing profile with a motor arrangement and landing pads retracted in accordance with embodiments of the present disclosure.
Figure 4B:
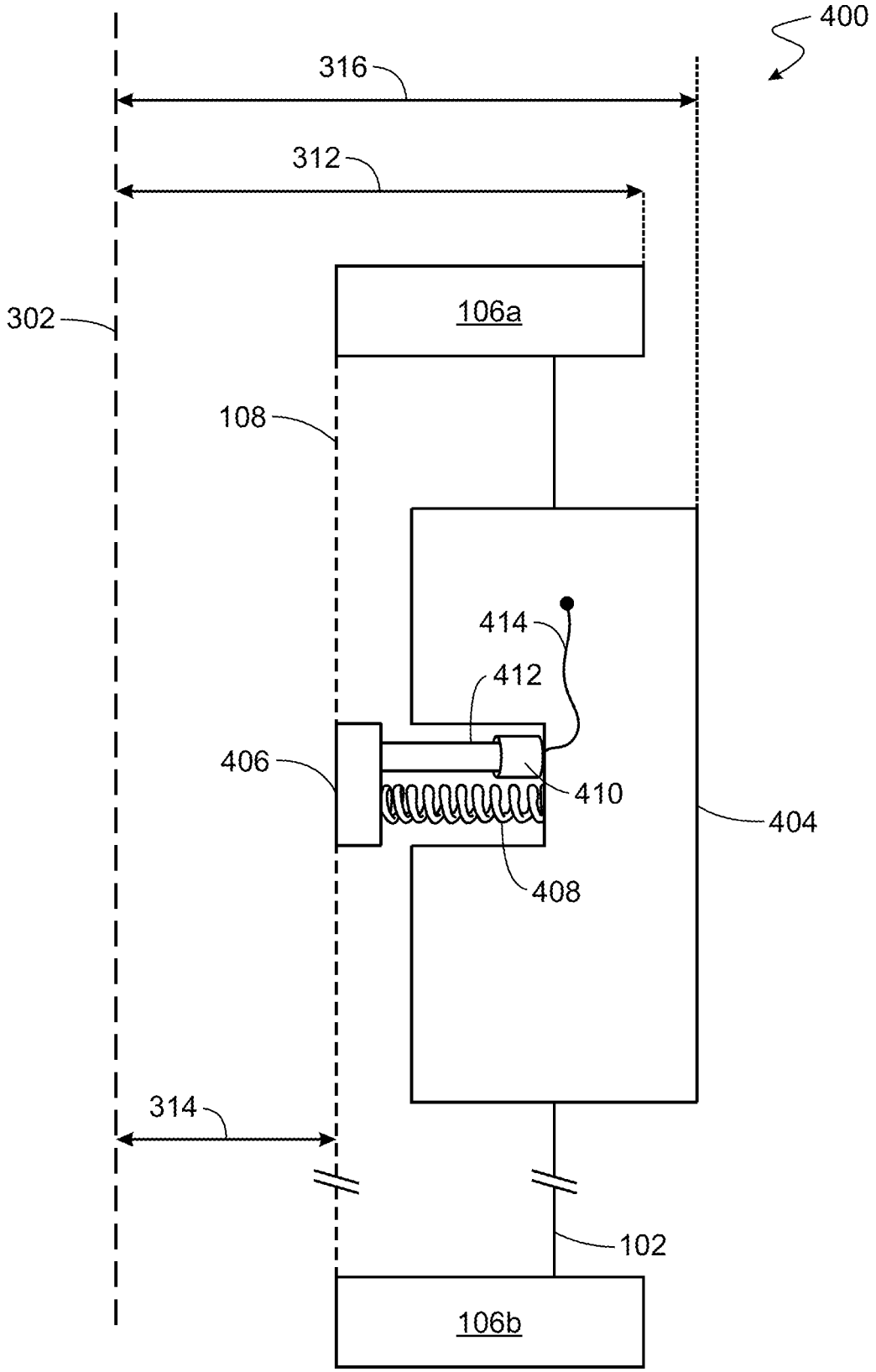
FIG. 4B is a schematic diagram of the example tubing with selective activated landing profile of FIG. 4A with a motor arrangement and landing pads extended in accordance with embodiments of the present disclosure.

FIG. 4A is a schematic diagram of an example tubing 400 with selective activated landing profile with a motor arrangement and landing pads retracted in accordance with embodiments of the present disclosure. FIG. 4B is a schematic diagram of the example tubing 400 with selective activated landing profile of FIG. 4A with a motor arrangement and landing pads extended in accordance with embodiments of the present disclosure. FIGS. 4A-B illustrate a half sectional view of an example embodiment of a tubing with selectively activated landing profile. A centerline 302 is shown that extends axially through the center of the tubing 400. The tubing includes an outer surface 102 and an inner surface 108 (shown as a dashed line). Tubing 400 has an inner diameter characterized by radius 314. The first outer diameter is based on the sizing of the flange 106*a* and is characterized by the radius 312 from the centerline to the outermost edge of the flange 106*a*.

The landing pad 404 (which is similar to landing pads 104*a-b*) is shown. Landing pad 404 can house a motor 410. Motor 410 drive a rod or screw or other linear driving element 412 radially towards or away from thrusting element 406. The motor 410 can be an electric motor or a hydraulic motor. The motor 410 can be controlled using a control line 414. Control line 422 can be a wired or wireless signal that can control electric motor. Or control line 414 can be a hydraulic control line that either controls hydraulic fluid from the surface to the motor 410 or causes local hydraulic fluid to actuate a rod or screw or other linear driving element 412 to push or retract from the thrusting element 406.

The tubing 400 includes a thrusting element 406. Thrusting element 306 is rigidly affixed to a surface of the tubing 400, such as the inner surface 108 or a side-wall surface formed by inner surface 108 and outer surface 102. The landing pad 404 is connected to the thrusting member 406 by a spring 408. The spring 408 has sufficient spring tension to hold the landing pad 404 in place when the thrusting member is not being interacted with.

In FIG. 4A, the motor 410 is not engaged and the landing pad 404 and the linear driving element 412 in a "retracted" position, where the linear drive element 412 does not apply a force on the thrusting element 406 to oppose the spring tension. The spring tension of spring 408 is sufficient to hold the landing pad 404 in place. In FIG. 4B, the motor 410 is actuated in a first direction, which drives the linear drive element 412 in a radial direction towards the stationary thrusting element 406. The force created by the motor pushing the linear driving element 412 into the stationary thrusting element opposes the spring tension and causes the landing pad to move radially outwards from the outer surface 102 of the tubing 300 and towards the wellbore wall (when operated in a wellbore). The extension of the landing pad 404 is illustrated by the landing pad diameter characterized by radius 316 extending from the centerline 302 to an outer edge of the landing pad 304. The radius 316 is greater than or equal to radius 312. Once secured, the motor can hold the linear driving element 412 in place, thereby holding the landing pad 304 in place to secure the tubing 300. Each landing pad can have its own motor, and the operator can operate each motor individually or cooperatively to secure the tubing 400 in the wellbore.

Figure 5:
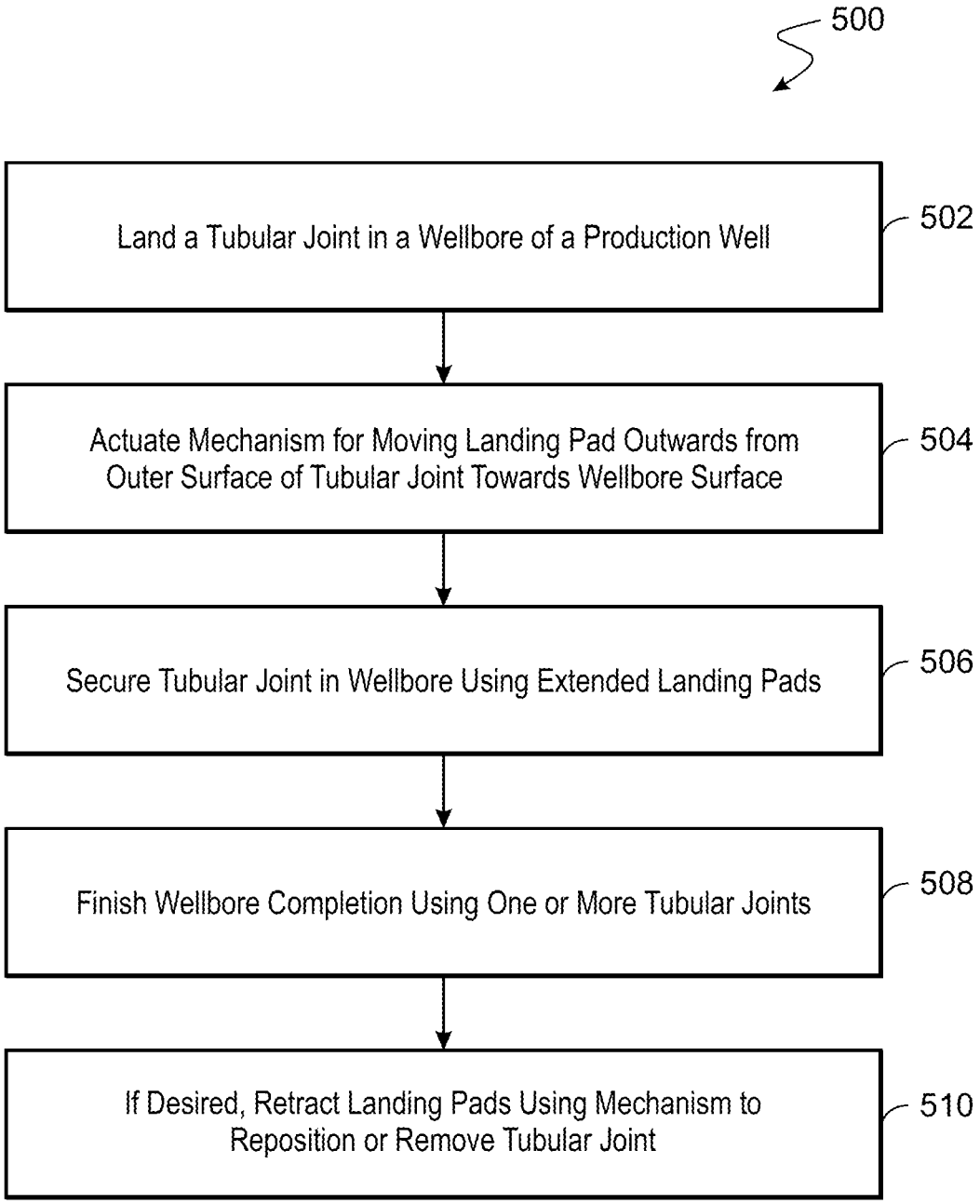
FIG. 5 is a flowchart of an example of a method for landing and operating a tubular joint with selective activated landing profile according to some implementations of the present disclosure.

FIG. 5 is a flowchart of an example of a method for landing and operating a tubular joint with selective activated landing profile according to some implementations of the present disclosure. For clarity of presentation, the description that follows generally describes method 500 in the context of the other figures in this description. However, it will be understood that method 500 can be performed, for example, by any suitable system, environment, software, and hardware, or a combination of systems, environments, software, and hardware, as appropriate. In some implementations, various steps of method 500 can be run in parallel, in combination, in loops, or in any order.

At 502, a tubing that includes a selectively activated landing profile can be introduced into a wellbore. The tubing can be introduced into the wellbore by conventional methodologies. The tubing can have the landing pads retracted for this step so that the tubing can be positioned at a desired location in the wellbore without the landing pads interfering with the surface of the wellbore. From 502, method 500 proceeds to 504.

At 504, after the tubing is positioned at the desired location in the wellbore, the landing pads can be extended. The landing pads can be extended such that one or more landing pads contacts a corresponding surface of the wellbore. The landing pads can be extended using a downhole shifting tool coupled to a control device on the surface by a wireline. The landing pads can be extended using a motor, such as an electric motor or hydraulic motor, controlled by a controller at the surface, either by a wireline or wireless communications link. The hydraulic motor can also include a hydraulic line for hydraulic fluid to travel to the hydraulic motor under pressure. The electric motor can include a power line to the surface to supply power to the electric motor.

A landing pad is extended by pushing against a thrusting element that is coupled to the landing pad by a spring and rigidly affixed to a surface of the tubing. By pushing on the stationary thrusting profile, the landing pad moves against the tension of the spring in an outward direction relative the tubing and towards the wellbore surface. The tension can be maintained by frictional forces of the shifting key wedged in place or by the static nature of the motor. From 504, method 500 proceeds to 506.

At 506, the landing pads contacting the surface of the wellbore secure the tubing in place within the wellbore. From 506, method 500 proceeds to 508.

At 508, more tubing is added as described here, in addition to other elements by conventional techniques, to complete the wellbore completion. From 508, method 500 proceeds to 510.

At 510, if desired, the landing pads can be retracted using the shifting key and tool or electric motor. The tubing can then be repositioned in or removed from the wellbore.

Figure 6:
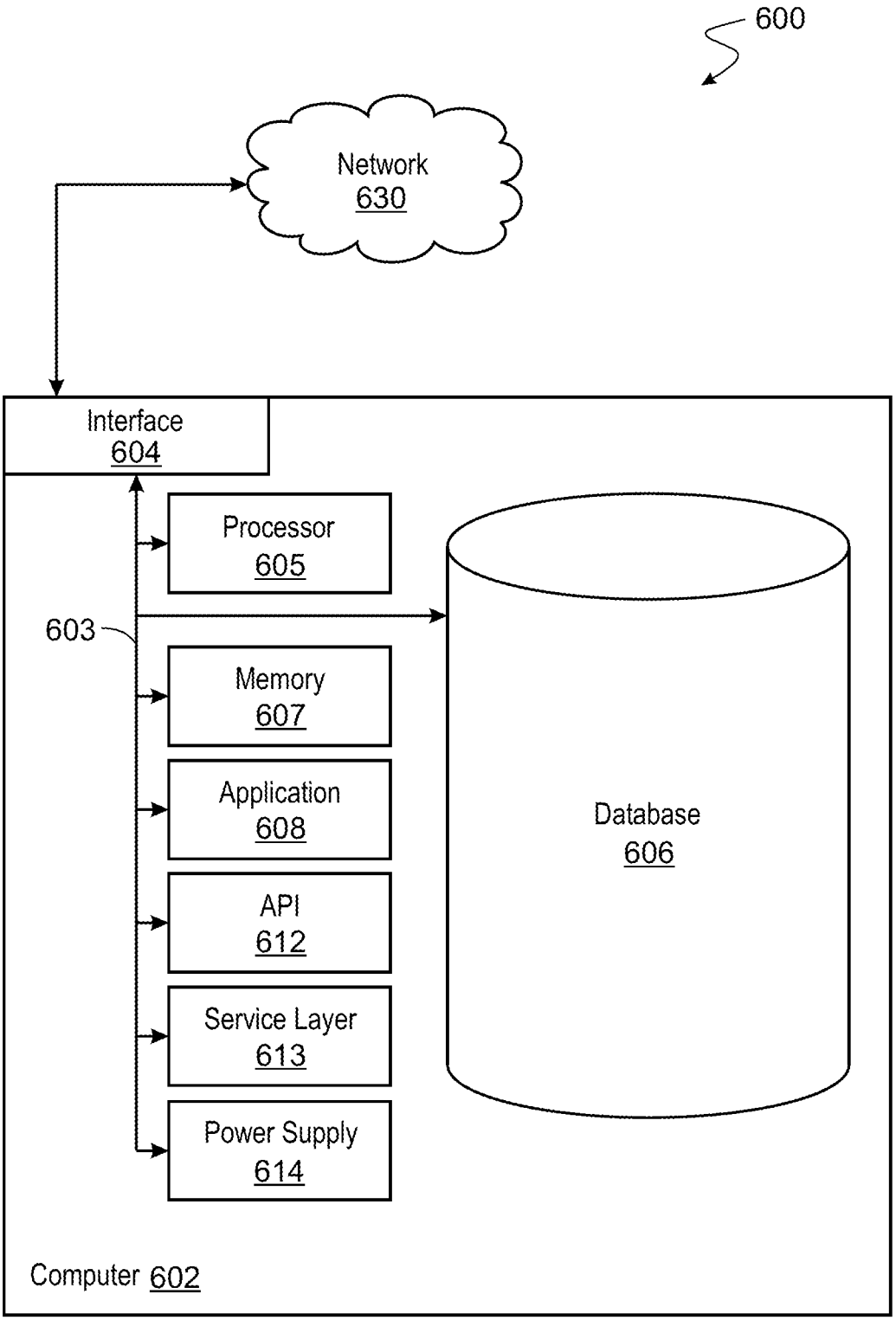
FIG. 6 is a block diagram illustrating an example computer system used to provide computational functionalities associated with described algorithms, methods, functions, processes, flows, and procedures as described in the present disclosure, according to some implementations of the present disclosure.

FIG. 6 is a block diagram of an example computer system 600 used to provide computational functionalities associated with described algorithms, methods, functions, processes, flows, and procedures described in the present disclosure, according to some implementations of the present disclosure. The illustrated computer 602 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 602 can include input devices such as keypads, keyboards, and touch screens that can accept user information. Also, the computer 602 can include output devices that can convey information associated with the operation of the computer 602. The information can include digital data, visual data, audio information, or a combination of information. The information can be presented in a graphical user interface (UI) (or GUI).

The computer 602 can serve in a role as a client, a network component, a server, a database, a persistency, or components of a computer system for performing the subject matter described in the present disclosure. The illustrated computer 602 is communicably coupled with a network 630. In some implementations, one or more components of the computer 602 can be configured to operate within different environments, including cloud-computing-based environments, local environments, global environments, and combinations of environments.

At a top level, the computer 602 is an electronic computing device operable to receive, transmit, process, store, and manage data and information associated with the described subject matter. According to some implementations, the computer 602 can also include, or be communicably coupled with, an application server, an email server, a web server, a caching server, a streaming data server, or a combination of servers.

The computer 602 can receive requests over network 630 from a client application (for example, executing on another computer 602). The computer 602 can respond to the received requests by processing the received requests using software applications. Requests can also be sent to the computer 602 from internal users (for example, from a command console), external (or third) parties, automated applications, entities, individuals, systems, and computers.

Each of the components of the computer 602 can communicate using a system bus 603. In some implementations, any or all of the components of the computer 602, including hardware or software components, can interface with each other or the interface 604 (or a combination of both) over the system bus 603. Interfaces can use an application programming interface (API) 612, a service layer 613, or a combination of the API 612 and service layer 613. The API 612 can include specifications for routines, data structures, and object classes. The API 612 can be either computer-language independent or dependent. The API 612 can refer to a complete interface, a single function, or a set of APIs.

The service layer 613 can provide software services to the computer 602 and other components (whether illustrated or not) that are communicably coupled to the computer 602. The functionality of the computer 602 can be accessible for all service consumers using this service layer. Software services, such as those provided by the service layer 613, can provide reusable, defined functionalities through a defined interface. For example, the interface can be software written in JAVA, C++, or a language providing data in extensible markup language (XML) format. While illustrated as an integrated component of the computer 602, in alternative implementations, the API 612 or the service layer 613 can be stand-alone components in relation to other components of the computer 602 and other components communicably coupled to the computer 602. Moreover, any or all parts of the API 612 or the service layer 613 can be implemented as child or sub-modules of another software module, enterprise application, or hardware module without departing from the scope of the present disclosure.

The computer 602 includes an interface 604. Although illustrated as a single interface 604 in FIG. 6, two or more interfaces 604 can be used according to particular needs, desires, or particular implementations of the computer 602 and the described functionality. The interface 604 can be used by the computer 602 for communicating with other systems that are connected to the network 630 (whether illustrated or not) in a distributed environment. Generally, the interface 604 can include, or be implemented using, logic encoded in software or hardware (or a combination of software and hardware) operable to communicate with the network 630. More specifically, the interface 604 can include software supporting one or more communication protocols associated with communications. As such, the network 630 or the interface's hardware can be operable to communicate physical signals within and outside of the illustrated computer 602.

The computer 602 includes a processor 605. Although illustrated as a single processor 605 in FIG. 6, two or more processors 605 can be used according to particular needs, desires, or particular implementations of the computer 602 and the described functionality. Generally, the processor 605 can execute instructions and can manipulate data to perform the operations of the computer 602, including operations using algorithms, methods, functions, processes, flows, and procedures as described in the present disclosure.

The computer 602 also includes a database 606 that can hold data for the computer 602 and other components connected to the network 630 (whether illustrated or not). For example, database 606 can be an in-memory, conventional, or a database storing data consistent with the present disclosure. In some implementations, database 606 can be a combination of two or more different database types (for example, hybrid in-memory and conventional databases) according to particular needs, desires, or particular implementations of the computer 602 and the described functionality. Although illustrated as a single database 606 in FIG. 6, two or more databases (of the same, different, or combination of types) can be used according to particular needs, desires, or particular implementations of the computer 602 and the described functionality. While database 606 is illustrated as an internal component of the computer 602, in alternative implementations, database 606 can be external to the computer 602.

The computer 602 also includes a memory 607 that can hold data for the computer 602 or a combination of components connected to the network 630 (whether illustrated or not). Memory 607 can store any data consistent with the present disclosure. In some implementations, memory 607 can be a combination of two or more different types of memory (for example, a combination of semiconductor and magnetic storage) according to particular needs, desires, or particular implementations of the computer 602 and the described functionality. Although illustrated as a single memory 607 in FIG. 6, two or more memories 607 (of the same, different, or combination of types) can be used according to particular needs, desires, or particular implementations of the computer 602 and the described functionality. While memory 607 is illustrated as an internal component of the computer 602, in alternative implementations, memory 607 can be external to the computer 602.

The application 608 can be an algorithmic software engine providing functionality according to particular needs, desires, or particular implementations of the computer 602 and the described functionality. For example, application 608 can serve as one or more components, modules, or applications. Further, although illustrated as a single application 608, the application 608 can be implemented as multiple applications 608 on the computer 602. In addition, although illustrated as internal to the computer 602, in alternative implementations, the application 608 can be external to the computer 602.

The computer 602 can also include a power supply 614. The power supply 614 can include a rechargeable or non-rechargeable battery that can be configured to be either user- or non-user-replaceable. In some implementations, the power supply 614 can include power-conversion and management circuits, including recharging, standby, and power management functionalities. In some implementations, the power-supply 614 can include a power plug to allow the computer 602 to be plugged into a wall socket or a power source to, for example, power the computer 602 or recharge a rechargeable battery.

There can be any number of computers 602 associated with, or external to, a computer system containing computer 602, with each computer 602 communicating over network 630. Further, the terms "client," "user," and other appropriate terminology can be used interchangeably, as appropriate, without departing from the scope of the present disclosure. Moreover, the present disclosure contemplates that many users can use one computer 602 and one user can use multiple computers 602.

In embodiments, the computer 602 can be used to control the actuation of the landing pads when the tubular joint is in the wellbore. The computer 602 can, for example, be used by an operator to control a downhole wireline shifting tool to operate the shifting key to engage or disengage the landing pad(s). Likewise, the operator can use computer 602 to control the electric or hydraulic motor to extend or retract the landing pad(s). The computer 602 can be any type of computer, including a stationary computer, mobile computer, mobile communications devices, or other computational and communications system.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/nonvolatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/-R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A tubular joint for a well string comprising:

an elongated tube comprising an inner surface and an outer surface;

a thrusting element affixed to the inner surface of the tubular joint; and a landing pad disposed along the tubular joint, the landing pad secured to the thrusting element by a spring;

wherein the landing pad is configured to move outward from the outer surface relative to the thrusting element;

the tubular joint further comprising an actuator to engage with the thrusting element, the actuator controllable to cause the thrusting element to selectively move radially outward and radially inward.

2. The tubular joint of claim 1, further comprising a shifting key disposed proximate to the thrusting member, the shifting key comprising a receiver to receive a tool that can move the shifting key towards or away from the thrusting element.

3. The tubular joint of claim 2, wherein the shifting key comprises a profile to interact with the thrusting member and push the landing pad outward from the outer surface of the tubular joint.

4. The tubular joint of claim 2, wherein the shifting key is actuated by a down-hole shifting tool.

5. The tubular joint of claim 1, further comprising an electric actuator, the electric actuator comprising a rod that upon actuation of the electric actuator in a first direction, pushes on the thrusting element to move the landing pad outward from the outer surface, and upon actuation of the electric actuator in a second direction causes the rod to retract from the thrusting element to allow the spring to retract the landing pad towards the outer surface.

6. The tubular joint of claim 5, wherein the electric actuator comprises a communications link to carry communications signals to the electric actuator.

7. The tubular joint of claim 1, further comprising a hydraulic actuator, the hydraulic actuator comprising a rod that, upon actuation of the hydraulic actuator in a first direction, pushes on the thrusting element to move the landing pad outward from the outer surface and upon actuation of the hydraulic actuator in a second direction causes the rod to retract from the thrusting element to allow the spring to retract the landing pad towards the outer surface.

8. Tubular joint of the claim 1, wherein the spring comprises a spring tension to resist motion of the landing pad in a direction outward from the outer surface.

9. The tubular joint of claim 1, further comprising a flange disposed at a distal end of the tubular joint, the flange defining a first outer diameter of the tubular joint; and wherein the landing pad defines a second outer diameter when in an extended position, the second outer diameter greater than or equal to the first outer diameter.

10. The tubular joint of claim 1, wherein the landing pad is configured to extend outward from the outer surface during operation and wherein the spring causes the landing pad to retract towards the outer surface when not in operation.

11. A method comprising:

in a production well comprising a wellbore having a wellbore surface:

landing a tubular joint inside of a wellbore, the wellbore;

applying a first force in a first direction against a thrusting member secured to the tubular joint, the thrusting member attached to a moveable landing pad by a spring; and causing the landing pad to move towards the wellbore surface to secure the tubular joint against the wellbore surface;

the method further comprising:

applying a second force in a second direction on the thrusting member; and causing the landing pad to move away from the wellbore based on the application of the second force on the thrusting member.

12. The method of claim 11, wherein applying the force against the thrusting member comprises moving, by a down-hole shifting tool, a shifting key towards the thrusting member to wedge the shifting key between the thrusting member and the landing pad.

13. The method of claim 12, further comprising retracting the landing pad by moving, using the down-hole shifting tool, the shifting key away from the thrusting member to allow the spring to pull the landing pad towards the thrusting member.

14. The method of claim 11, wherein applying the force against the thrusting member comprises actuating an electric motor coupled to the landing pad in a first direction to drive a rod onto the thrusting member to push the landing pad away from the thrusting member.

15. The method of claim 14, further comprising retracting the landing pad by actuating the electric motor in a second direction, opposite the first direction, to move the rod away from the thrusting member to allow the spring to pull the landing pad towards the thrusting member.

16. The method of claim 11, wherein applying the force against the thrusting member comprises actuating a hydraulic drive to drive a rod onto the thrusting member to push the landing pad away from the thrusting member.

17. The method of claim 16, further comprising retracting the landing pad by releasing the hydraulic drive to move the rod away from the thrusting member to allow the spring to pull the landing pad towards the thrusting member.

18. A well system comprising:

a wellbore comprising a wellbore surface;

a tubular joint placed within the wellbore, the tubular joint comprising:

an elongated tube comprising an inner surface and an outer surface;

a thrusting element affixed to the inner surface of the tubular joint; and a landing pad disposed along the tubular joint, the landing pad secured to the thrusting element by a spring;

wherein the landing pad is configured to move outward from the outer surface relative to the thrusting element; and wherein the well system comprises an actuator to selectively move the thrusting element radially outwards or radially inwards.

19. The system of claim 18, wherein the tubular joint comprises a plurality of landing pads disposed around the tubular joint, the plurality of landing pads each individually movable in a radial direction relative to the elongated tube to secure the tubular joint in the wellbore.

20. The system of claim 18, comprising one of a shifting key, an electric motor, or a hydraulic drive to move the landing pad towards the wellbore surface to secure the tubular joint in the wellbore during operation of the well system.

* * * * *